US006280154B1

(12) United States Patent
Clendenin et al.

(10) Patent No.: US 6,280,154 B1
(45) Date of Patent: Aug. 28, 2001

(54) SCROLL COMPRESSOR

(75) Inventors: Harry Clendenin; Keith James Reinhart, both of Sidney, OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/496,807

(22) Filed: Feb. 2, 2000

(51) Int. Cl.[7] ..... F04B 17/03
(52) U.S. Cl. ..... 417/410.5; 418/55.1
(58) Field of Search ..... 417/410.5; 418/55.1

(56) References Cited

U.S. PATENT DOCUMENTS

| | | | |
|---|---|---|---|
| Re. 33,652 | | 7/1991 | Yamamura et al. . |
| 2,174,233 | | 9/1939 | Body et al. . |
| 2,243,466 | | 5/1941 | Kucher . |
| 3,178,102 | | 4/1965 | Grisbrook . |
| 3,288,357 | | 11/1966 | Comstock et al. . |
| 3,513,476 | | 5/1970 | Monden et al. . |
| 4,470,772 | | 9/1984 | Gannaway . |
| 4,768,936 | | 9/1988 | Etemad et al. . |
| 4,795,321 | | 1/1989 | Etemad et al. . |
| 4,795,322 | | 1/1989 | Etemad et al. . |
| 4,811,471 | | 3/1989 | Etemad et al. . |
| 4,834,627 | | 5/1989 | Gannaway . |
| 4,854,831 | | 8/1989 | Etemad et al. . |
| 4,971,529 | | 11/1990 | Gannaway et al. . |
| 5,037,278 | | 8/1991 | Fujio et al. . |
| 5,099,658 | | 3/1992 | Utter et al. . |
| 5,101,644 | | 4/1992 | Crum et al. . |
| 5,139,394 | | 8/1992 | Aikawa et al. . |
| 5,142,885 | | 9/1992 | Utter et al. . |
| 5,186,546 | | 2/1993 | Abe . |
| 5,212,964 | | 5/1993 | Utter et al. . |
| 5,345,785 | | 9/1994 | Sekigami et al. . |
| 5,380,170 | | 1/1995 | Fain . |
| 5,449,279 | | 9/1995 | Hill et al. . |
| 5,462,419 | | 10/1995 | Hill et al. . |
| 5,579,651 | | 12/1996 | Sugiyama et al. . |
| 5,616,016 | | 4/1997 | Hill et al. . |
| 5,667,371 | * | 9/1997 | Prenger et al. ..... 418/55.1 |
| 5,720,602 | | 2/1998 | Hill et al. . |
| 5,730,588 | | 3/1998 | Terai et al. . |
| 5,800,141 | * | 9/1998 | Ceylan et al. ..... 418/55.1 |
| 5,855,475 | | 1/1999 | Fujio et al. . |
| 6,056,523 | * | 5/2000 | Won et al. ..... 418/55.1 X |
| 6,056,524 | * | 5/2000 | Williams et al. ..... 418/55.1 |

OTHER PUBLICATIONS

Boothroyd, et al., Product Design for Manufacture and Assembly, Dec. 1994, Marcel Dekker, Inc. (New York), pp. 64, 65, 68, 77–80, 165.*

* cited by examiner

*Primary Examiner*—Charles G. Freay
*Assistant Examiner*—David J. Torrente
(74) *Attorney, Agent, or Firm*—Harness, Dickey & Pierce, P.L.C.

(57) ABSTRACT

A scroll compressor has a shell within which is positioned a frame. The frame is supported by a base portion of the shell to prevent axial movement of the frame with respect to the shell. A motor stator, a main bearing housing and a lower bearing housing are each positioned within the shell by engagement with the frame. A drive member which includes a motor rotor is rotatably supported by both the main bearing housing and the lower bearing housing. The frame, by positioning the motor stator, the main bearing housing and the lower bearing housing, allows the "air gap" between the motor stator and the motor rotor to be accurately controlled.

25 Claims, 3 Drawing Sheets

14
18
20
80
84
10
78
74
76
82
72
56
58
70
60
68
32
54
62
96
64
66
50
24
106
104
34
98
40
94
22
46
2
28
2
12
92
48
30
52
90
100
102
26
36
16
38
44

FIG. 2.
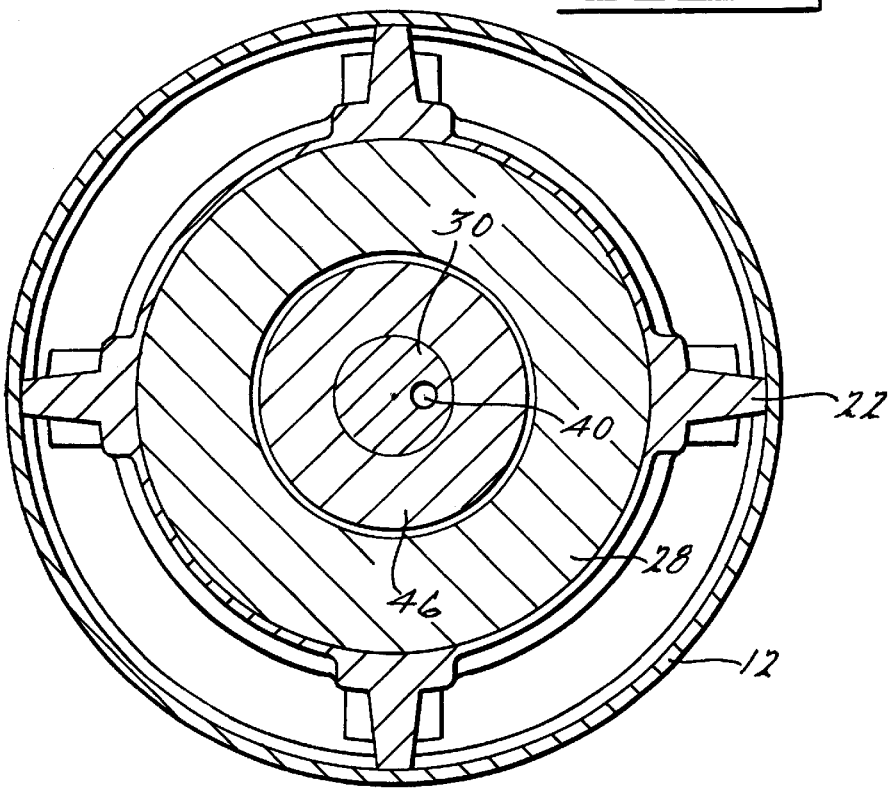
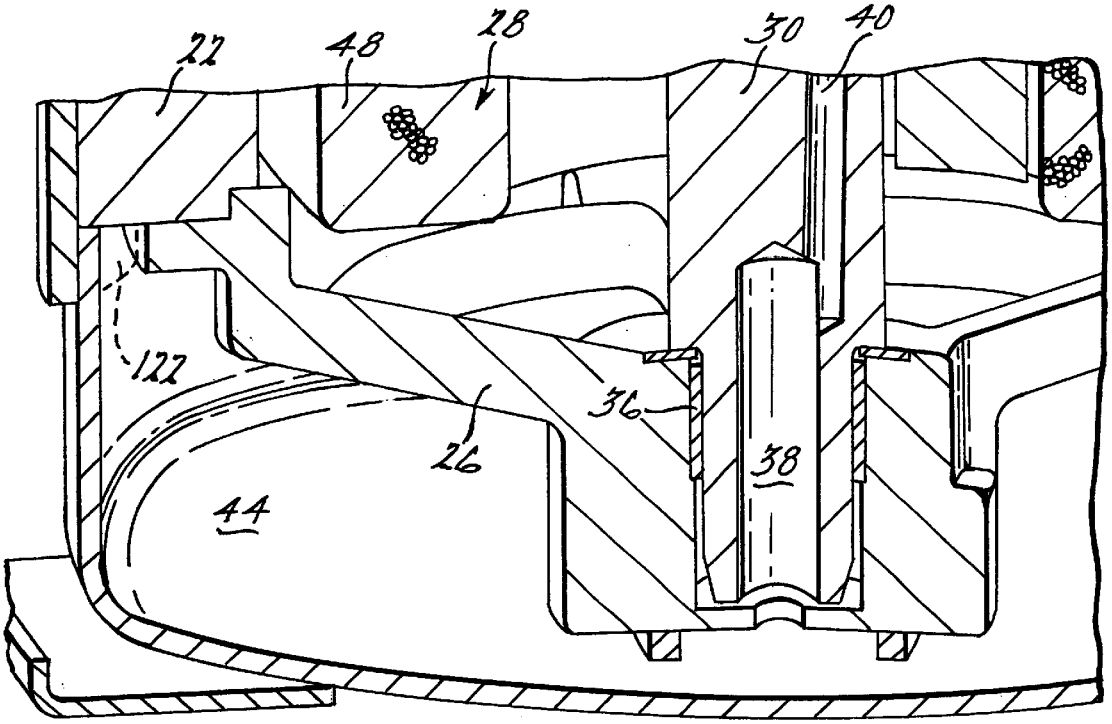
FIG. 3.

SCROLL COMPRESSOR

FIELD OF THE INVENTION

The present invention relates to scroll machines. More particularly, the present invention relates to a locating and supporting system for the main bearing housing and the lower bearing housing for a scroll compressor.

BACKGROUND AND SUMMARY OF THE INVENTION

A class of machines exists in the art generally known as scroll machines which are used for the displacement of various types of fluid. The scroll machines can be configured as an expander, a displacement engine, a pump, a compressor etc. and the features of the present invention are applicable to any one of these machines. For purposes of illustration, however, the disclosed embodiment is in the form of a hermetic refrigerant scroll compressor.

Scroll compressors are becoming more and more popular for use as compressors in both refrigeration as well as air conditioning applications due primarily to their capability for extremely efficient operation. Generally, these machines incorporate a pair of intermeshed spiral wraps, one of which is caused to orbit relative to the other so as to define one or more moving chambers which progressively decrease in size as they travel from an outer suction port toward a center discharge port. An electric motor is provided which operates to drive the orbiting scroll member via a suitable drive shaft affixed to the motor rotor. In a hermetic compressor, the bottom of the hermetic shell normally contains an oil sump for lubricating and cooling purposes.

The electric motor typically includes a motor stator which is press fit into a shell of the compressor. The drive shaft is typically press fit to the motor rotor and it is rotatably secured by a main bearing housing and a lower bearing housing. Each bearing housing is also secured to the shell of the compressor. The motor rotor is located within the central bore of the motor stator with a specific clearance being designed between the motor stator and the motor rotor. The toleranced dimension for this clearance is a function of the stator tolerances, the shell tolerances, the two bearing housing tolerances, the driveshaft tolerances and the motor rotor tolerances. Thus, the final dimension for the clearance between the motor rotor and the motor stator can be greater than the optimum clearance desired by the designer of the compressor.

The present invention provides the art with a locating and supporting system which significantly decreases the variance in the clearance dimension between the motor rotor and the motor stator. The tighter control of this clearance increases the operating efficiency of the electric motor. The locating and supporting system includes a bearing housing locating frame which is press fit within the shell and which is supported by the base of the shell. The motor stator is press fit within the frame and the two bearing housings are bolted to the frame. Thus, by accurate machining of the frame the positional relationship between the motor stator and the motor rotor can be accurately controlled and thus the clearance or "air gap" between these two components can be tightly controlled. The tight control of the "air gap" leads to an increased operating efficiency of the electric motor. In addition, the unitization of the bearing housings, stator, rotor and crankshaft with the locating frame simplifies the assembly of the scroll compressor.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 2 is a cross-sectional view taken in the direction of arrows 2—2 shown in FIG. 1;

FIG. 3 is a perspective view of the lower bearing housing area shown in FIG. 1 partially in cross-section.

DETAILED DESCRIPTION OF THE PREFERRED EMBODIMENT

Figure 1:
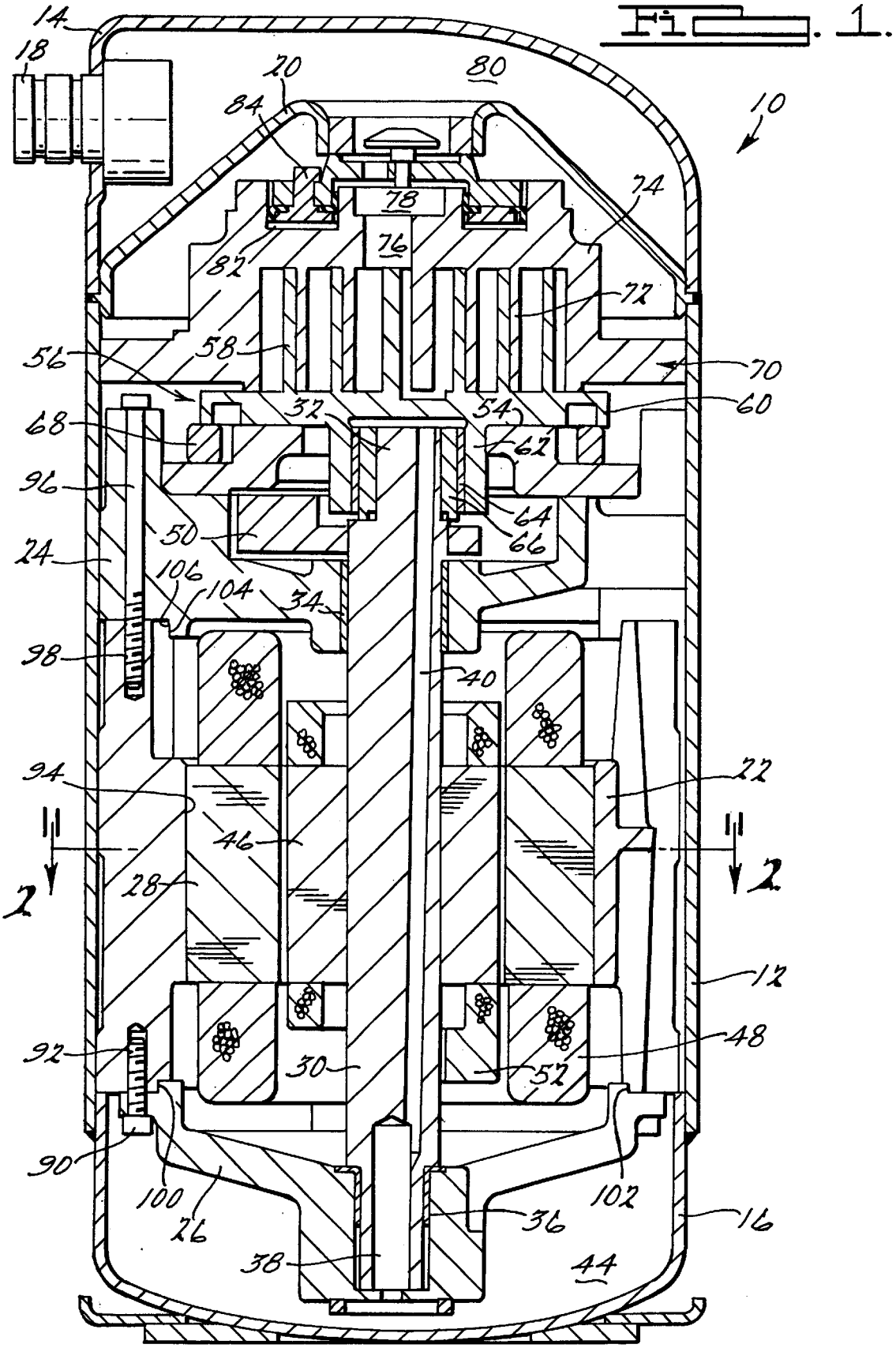
FIG. 1 is a vertical cross section of a hermetic scroll compressor incorporating the unique locating and supporting system of the present invention.
Figure 4:
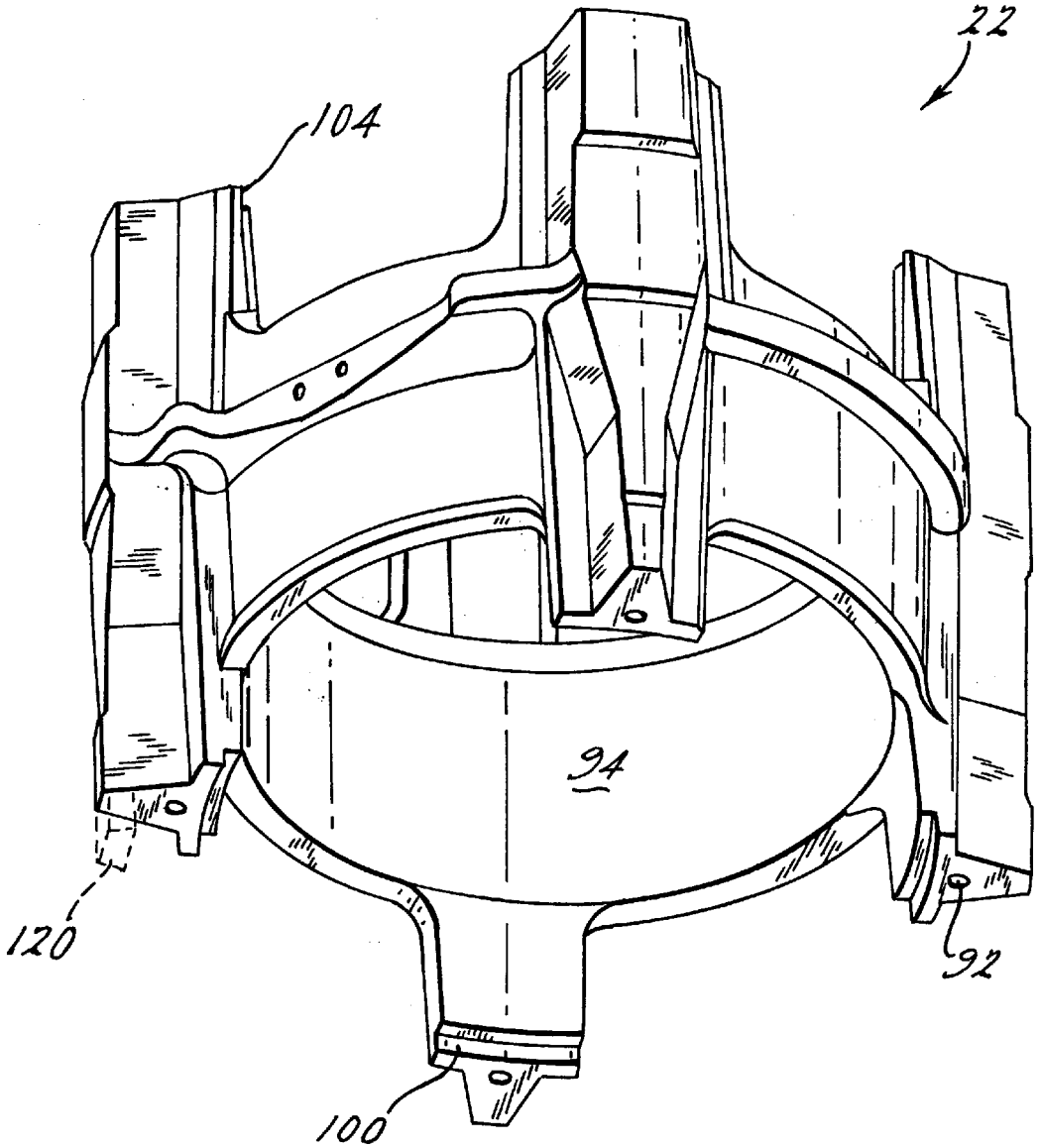
FIG. 4 is a bottom perspective view of the bearing housing locating frame shown in FIGS. 1–3.

Referring now to the drawings in which like reference numerals designate like or corresponding parts throughout the several views, there is shown in FIGS. 1–4 a scroll compressor incorporating the unique locating and supporting system in accordance with the present invention and which is indicated generally by the reference numeral 10. Scroll compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein. A transversely extending partition 20 is affixed to shell 12 by being welded about its periphery at the same point that cap 14 is welded to shell 12. A compressor mounting frame 22 is press fit within shell 12 and is supported by the end of base 16. Base 16 is slightly smaller in diameter than shell 12 such that base 16 is received within shell 12 and welded about its periphery as shown in FIG. 1.

Major elements of compressor 10 that are affixed to frame 22 include a two-piece main bearing housing 24, a lower bearing housing 26 and a motor stator 28. A drive shaft or crankshaft 30 having an eccentric crank pin 32 at the upper end thereof is rotatably journaled in a bearing 34 secured within main bearing housing 24 and a second bearing 36 secured within lower bearing housing 26. Crankshaft 30 has at the lower end thereof a relatively large diameter concentric bore 38 which communicates with a radially outwardly positioned smaller diameter bore 40 extending upwardly therefrom to the top of crankshaft 30. The lower portion of the interior of shell 12 defines an oil sump 44 which is filled with lubricating oil to a level slightly above the lower end of a rotor 46, and bore 38 acts as a pump to pump lubricating fluid up crankshaft 30 and into bore 40 and ultimately to all of the various portions of compressor 10 which require lubrication.

Crankshaft 30 is rotatably driven by an electric motor which includes stator 28, winding 48 passing therethrough and rotor 46 press fitted on crankshaft 30. An upper counterweight 50 is secured to crankshaft 30 and a lower counterweight 52 is secured to rotor 46.

The upper surface of two-piece main bearing housing 24 is provided with a flat thrust bearing surface 54 on which is disposed an orbiting scroll member 56 having the usual spiral vane or wrap 58 extending upward from an end plate 60. Projecting downwardly from the lower surface of end plate 60 of orbiting scroll member 56 is a cylindrical hub 62 having a journal bearing 64 therein and in which is rotatively disposed a drive bushing 66 having an inner bore in which crank pin 32 is drivingly disposed. Crank pin 32 has a flat on one surface which drivingly engages a flat surface formed in a portion of the inner bore of drive bushing 66 to provide a radially compliant driving arrangement, such as shown in assignee's U.S. Pat. No. 4,877,382, the disclosure of which is hereby incorporated herein by reference. An Oldham coupling 68 is also provided positioned between orbiting scroll member 56 and two-piece bearing housing 24. Oldham coupling 68 is keyed to orbiting scroll member 56 and to a non-orbiting scroll member 70 to prevent rotational movement of orbiting scroll member 56.

Non-orbiting scroll member 70 is also provided with a wrap 72 extending downwardly from an end plate 74 which is positioned in meshing engagement with wrap 58 of orbiting scroll member 56. Non-orbiting scroll member 70 has a centrally disposed discharge passage 76 which communicates with an upwardly open recess 78 which is in turn is in fluid communication with a discharge muffler chamber 80 defined by cap 14 and partition 20. An annular recess 82 is also formed in non-orbiting scroll member 70 within which is disposed a floating seal assembly 84.

Recesses 78 and 82 and floating seal assembly 84 cooperate to define axial pressure biasing chambers which receive pressurized fluid being compressed by wraps 58 and 72 so as to exert an axial biasing force on non-orbiting scroll member 70 to thereby urge the tips of respective wraps 58 and 72 into sealing engagement with the opposed end plate surfaces of end plates 74 and 60, respectively. Floating seal assembly 84 is preferably of the type described in greater detail in assignee's U.S. Pat. No. 5,156,539, the disclosure of which is hereby incorporated herein by reference. Non-orbiting scroll member 70 is designed to be mounted for limited axial movement to two-piece main bearing housing 24 in a suitable manner such as disclosed in the aforementioned U.S. Pat. No. 4,877,382 or assignee's U.S. Pat. No. 5,102,316, the disclosure of which is hereby incorporated herein by reference.

The present invention is directed to the unique locating and supporting system illustrated in the drawings and which includes base 16, frame 22, main bearing housing 24 and lower bearing housing 26. In a typical prior art compressor, the main bearing housing, the motor stator and the lower bearing housing are all secured to the shell of the compressor. For efficient operation of the motor, the clearance or "air gap" between the motor rotor and the motor stator must be tightly controlled. When all of the mounting components for the motor rotor and the motor stator are mounted to the shell of the compressor, they must rely on the accuracy of the shell to tightly control the "air gap".

Frame 22 provides an alternative to relying on the accuracy of shell 12 for controlling the "air gap". In the present invention, frame 22 is secured to shell 12 and motor stator 28, main bearing housing 24 and lower bearing housing 26 are secured to frame 22. Thus, the machining of frame 22 will control the "air gap" between motor stator 28 and motor rotor 46. Since the machining of frame 22 can be controlled significantly better than the dimensional tolerances of shell 12, the incorporation of frame 22 reduces the tolerances associated with the "air gap" and thus increases the efficiency of the electric motor.

Frame 22 is press fit within shell 12 to a position which abuts or is positioned slightly spaced from base 16. Base 16 can be secured to shell 12 before or after frame 22 with the only consideration being the assembly of lower bearing housing 26, motor stator 28 and main bearing housing 24 before or after frame 22 is press fit within shell 12. The abutting of frame 22 to base 16 provides axial support for frame 22 within shell 12. When frame 22 is slightly spaced from base 16, any axial movement of frame 22 which may be caused by adverse running operations of compressor 10 will cause frame 22 to abut base 16 to limit the amount of axial flow. Lower bearing housing 26 is secured to frame 22 with a plurality of bolts 90 which are threadingly received within threaded bores 92 located within frame 22. Stator 28 is press fit within a central bore 94 defined by frame 22. Main bearing housing 24 is secured to frame 22 with a plurality of bolts 96 which are threadingly received within threaded bores 98 located within frame 22. Motor rotor 46 is press fit to drive shaft 30 and is rotatably supported within the central opening of motor stator 28 by bearing 34 in two-piece main bearing housing 24 at one end and by bearing 36 in lower bearing housing 26 at its opposite end. Since all three locating components, stator 28, main bearing housing 24 and lower bearing housing 26 rely on a machined feature of frame 22 for controlling their position, by keeping a tight control on threaded bores 92, central bore 94 and threaded bores 98 in relation to each other, accuracy of the "air gap" can be tightly controlled.

In addition, frame 22 is provided with a first pilot or locating inner surface or diameter 100 and lower bearing housing 26 is provided with a pilot or locating outer surface or diameter 102. Frame 22 is also provided with a second pilot or locating inner surface or diameter 104 and main bearing housing 24 is provided with a pilot or locating outer surface or diameter 106. Thus, by controlling the location or concentricity between central bore 94, inner surface or diameter 100 and inner surface or diameter 104 along with controlling the location or concentricity of outer surface or diameter 102 with the bore within lower bearing housing 26 which accepts bearing 36 and controlling the location or concentricity of outer surface or diameter 106 with the bore within two-piece main bearing housing 24 which accepts bearing 34, the accurate positioning of motor rotor 46 within motor stator 28 can be accomplished. The accurate positioning of motor rotor 46 within motor stator 28 will in turn accurately control the dimension for the "air gap" between these two components. The utilization of surfaces or diameters 100–106 eliminate the tight tolerancing of threaded bores 92 and 98 since bolts 90 and 96 are only used to secure bearing housings 24 and 26 to frame 22 and diameters 100–106 determines their location. The use of surfaces or diameters 100–106 for determining the relative location of motor rotor 46 and motor stator 28 is the preferred embodiment of the present invention.

Frame 22 is press fit within shell 12 and should thus be able to resist rotational motion within shell 12. One method of ensuring that there will be no rotational movement of frame 22 within shell 12 would be to provide frame 22 with a plurality of tabs 120 (shown in phantom in FIG. 4) which engage a plurality of slots 122 (shown in phantom in FIG. 3) in base 16. Since base 16 is welded to shell 12, the engagement between tabs 120 and slots 122 will further resist any rotational movement of frame 22.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

an outer shell;

a cap secured to said shell;

a base telescopically engaging said outer shell;

a first scroll member disposed within said outer shell, said first scroll member having a first spiral wrap projecting outwardly from a first end plate;

a second scroll member disposed within said outer shell, said second scroll member having a second spiral wrap projecting outwardly from a second end plate, said second scroll wrap being interleaved with said first spiral wrap to define a plurality of moving chambers therebetween when said second scroll member orbits with respect to said first scroll member;

a frame disposed within and secured directly to said outer shell, said frame abutting said base;

a motor stator secured to said frame, said motor stator defining a central bore;

a main bearing housing separate from and secured to said frame;

a lower bearing housing separate from and secured to said frame;

a drive member rotatably supported by said main bearing housing and said lower bearing housing, said drive member causing said second scroll member to orbit with respect to said first scroll member; and a motor rotor secured to said drive member, said motor rotor being disposed within said central bore of said motor stator.

2. The scroll machine according to claim 1, wherein said main bearing housing defines a first pilot surface and said frame defines a second pilot surface, said first pilot surface engaging said second pilot surface to position said main bearing housing with respect to said frame.

3. The scroll machine according to claim 2, wherein an outer surface of said motor stator engages an inner surface of said frame to position said motor stator with respect to said frame.

4. The scroll machine according to claim 2, wherein said main bearing housing positions a bearing for supporting said drive member.

5. The scroll machine according to claim 2, wherein said lower bearing housing defines a third pilot surface and said frame defines a fourth pilot surface, said third pilot surface engaging said fourth pilot surface to position said lower bearing housing with respect to said frame.

6. The scroll machine according to claim 5, wherein an outer surface of said motor stator engages an inner surface of said frame to position said motor stator with respect to said frame.

7. The scroll machine according to claim 5, wherein said main bearing housing positions a first bearing for supporting said drive member and said lower bearing housing positions a second bearing for supporting said drive member.

8. The scroll machine according to claim 5, wherein said first scroll member is mounted to said main bearing housing, said first scroll member being capable of axial movement with respect to said main bearing housing.

9. The scroll machine according to claim 8, wherein said second scroll member engages said main bearing housing.

10. The scroll machine according to claim 5, wherein said second scroll member engages said main bearing housing.

11. The scroll machine according to claim 2, wherein said first scroll member is mounted to said main bearing housing, said first scroll member being capable of axial movement with respect to said main bearing housing.

12. The scroll machine according to claim 11, wherein said second scroll member engages said main bearing housing.

13. The scroll machine according to claim 2, wherein said second scroll member engages said main bearing housing.

14. The scroll machine according to claim 1, wherein said lower bearing housing defines a first pilot surface and said frame defines a second pilot surface, said first pilot surface engaging said second pilot surface to position said lower bearing housing with respect to said frame.

15. The scroll machine according to claim 14, wherein an outer surface of said motor stator engages an inner surface of said frame to position said motor stator with respect to said frame.

16. The scroll machine according to claim 14, wherein said lower bearing housing positions a bearing for supporting said drive member.

17. The scroll machine according to claim 14, wherein said first scroll member is mounted to said main bearing housing, said first scroll member being capable of axial movement with respect to said main bearing housing.

18. The scroll machine according to claim 17, wherein said second scroll member engages said main bearing housing.

19. The scroll machine according to claim 14, wherein said second scroll member engages said main bearing housing.

20. The scroll machine according to claim 1, wherein said first scroll member is mounted to said main bearing housing, said first scroll member being capable of axial movement with respect to said main bearing housing.

21. The scroll machine according to claim 20, wherein said second scroll member engages said main bearing housing.

22. The scroll machine according to claim 1, wherein said second scroll member engages said main bearing housing.

23. A scroll machine comprising:

an outer shell;

a first scroll member disposed within said outer shell, said first scroll member having a first spiral wrap projecting outwardly from a first end plate;

a second scroll member disposed within said outer shell, said second scroll member having a second spiral wrap projecting outwardly from a second end plate, said second scroll wrap being interleaved with said first spiral wrap to define a plurality of moving chambers therebetween when said second scroll member orbits with respect to said first scroll member;

a frame disposed within and secured directly to said outer shell; and a base secured to said outer shell, said base telescopically engaging said outer shell to abut said frame to prevent movement of said frame with respect to said shell.

24. The scroll machine according to claim 23, wherein said frame is press-fit within said shell.

25. The scroll machine according to claim 23, wherein said frame includes at least one tab and said base includes at least one slot, said tab engaging said slot to resist rotational movement of said frame.

* * * * *